United States Patent [19]

Thorud et al.

[11] Patent Number: 5,020,674

[45] Date of Patent: Jun. 4, 1991

[54] COLLAPSIBLE CONTAINER AND PALLET ASSEMBLY

[75] Inventors: Stanley R. Thorud, Plymouth; LeRoy Miller, Rogers, both of Minn.

[73] Assignee: Liberty Diversified Industries, New Hope, Minn.

[21] Appl. No.: 470,942

[22] Filed: Jan. 26, 1990

[51] Int. Cl.[5] ..... B65D 19/20

[52] U.S. Cl. ..... 206/600; 229/23 R

[58] Field of Search ..... 206/386, 320, 595–600; 220/6; 229/23 R

[56] References Cited

U.S. PATENT DOCUMENTS

| | | | |
|---|---|---|---|
| 2,801,740 | 8/1957 | Fallert | 206/559 |
| 3,552,466 | 1/1971 | Fairchilds | 206/386 |
| 4,230,227 | 10/1980 | Kowall et al. | 206/600 |
| 4,535,929 | 8/1985 | Sherman, II et al. | 206/807 |
| 4,697,699 | 10/1987 | Schneider | 206/599 |

FOREIGN PATENT DOCUMENTS

| | | | |
|---|---|---|---|
| 2457811 | 1/1981 | France | 206/599 |
| 2594800 | 8/1987 | France | 206/386 |
| 2596021 | 9/1987 | France | 206/386 |

*Primary Examiner*—Jimmy G. Foster
*Attorney, Agent, or Firm*—Moore & Hansen

[57] ABSTRACT

A container and pallet assembly comprising a generally rectangular pallet with a pair of end walls and a pair of side walls mounted thereon. The container may be folded between an upright container configuration and a collapsed stored configuration. Each end or side wall is constructed from double-faced corrugated plastic sheet material cut and scored to form a blank having hingedly interconnected inner, intermediate, and outer wall panels, lid flaps, and attachment panels. The side or wall panels may be slidably mounted on the pallet using a combination of slots in the associated attachment panels and push-type fasteners to facilitate folding to the stored configuration. The end or side wall blanks may also define internal reinforcing structures for supporting the containers when stacked in a vertical column, and securing structures for fastening the end and side walls in the upright container configuration. The panels of the end and side walls may also form an upwardly projecting peripheral rim which can be engagingly received in a channel defined along the underside of the pallet.

54 Claims, 9 Drawing Sheets

COLLAPSIBLE CONTAINER AND PALLET ASSEMBLY

BACKGROUND OF THE INVENTION

This invention relates generally to a collapsible container and pallet assembly for transporting products by carrier, and particularly to an assembly wherein the container is formed from a plurality of separate blanks of corrugated plastic folded to form upright side walls and lid flaps.

Many types of folded cardboard, fiberboard, and plastic cartons, boxes, and tote containers are known to the art. Similarly, there are known a variety of wooden, plastic, and fiber shipping pallets, such as those used with hand trucks, fork lifts, or specially designed commercial carrier cargo transport compartments.

In some applications the fabrication of an integral container and pallet assembly has proven desirable, particularly for shipping partially completed products from a first plant to a remote location where assembly or fabrication is completed, with the container and pallet assemblies being returned by air or other carrier to the original plant for reuse. One example would include the stamping or cutting of fabric sheet goods into patterns, with the patterns being completed and assembled at the remote location. For this purpose, conventional metal pallets with molded plastic or wooden containers have been utilized.

However, such assemblies are heavy and therefore expensive to ship, and cannot be folded or collapsed to minimize return costs. They are also subject to breakage if dropped or struck in transit, therefore requiring replacement of the entire container or assembly.

BRIEF SUMMARY OF THE INVENTION

It is therefore one object of this invention to design a container and pallet assembly having hinged side walls, end walls and lid flaps, and which can be folded between an upright container configuration and a collapsed configuration.

It is an additional object of this invention to design the above container and pallet assembly such that the side and end walls will be flexible or yielding and therefore highly resistant to breakage if dropped or struck, yet resilient and capable of stacking several like container and pallet assemblies in a self-supporting vertical column.

It is a related object of this invention to design the above container and pallet assembly such that the end walls or side walls can be individually replaced if damaged.

It is a distinct object of this invention to design the above container and pallet assembly such that the side and end walls include a plurality of parallel abutting panels formed integrally in a blank with the associated lid flaps, and wherein those panels may further define internal support structures such as reinforcing columns, and external securing structures for securing the side walls and end walls in the upright configuration.

It is an associated object of this invention to design the above container and pallet assembly such that the panels of the side and end walls form an upwardly projecting peripheral rim which will be received partially and engaged within a channel formed in the bottom of a like pallet stacked in a vertical column.

It is yet another object of this invention to design the above container and pallet assembly such that the side walls, end walls, and lid flaps can be folded to a completely collapsed configuration adjacent to and parallel with the top of the pallet, with a like container and pallet assembly resting thereon and protecting the collapsed side walls and end walls.

It is a related object of this invention to design the above container and pallet assembly such that at least two of the side walls or end walls will be slidably attached to the pallet to permit movement of the walls relative to the pallet to accomplish complete folding to the collapsed configuration without interference between the walls, panels, flaps, or associated reinforcing or securing structures.

Briefly described, the container and pallet assembly of this invention comprises a generally rectangular pallet with a pair of end walls and a pair of side walls mounted thereon. The container may be folded between an upright container configuration and a collapsed stored configuration. Each end or side wall is constructed from double-faced corrugated plastic sheet material cut and scored to form a blank having hingedly interconnected inner, intermediate, and outer wall panels, lid flaps, and attachment panels. The side or wall panels may be slidably mounted on the pallet using a combination of slots in the associated attachment panels and push-type fasteners to facilitate folding to the stored configuration. The end or side wall blanks may also define internal reinforcing structures for supporting the containers when stacked in a vertical column, and securing structures for fastening the end and side walls in the upright container configuration. The panels of the end and side walls may also form an upwardly projecting peripheral rim which can be engagingly received in a channel defined along the underside of the pallet.

DESCRIPTION OF THE PREFERRED EMBODIMENT

The collapsible container and pallet assembly of this invention is shown in FIGS. 1-16 and referenced generally therein by the numeral 10.

Figure 1:
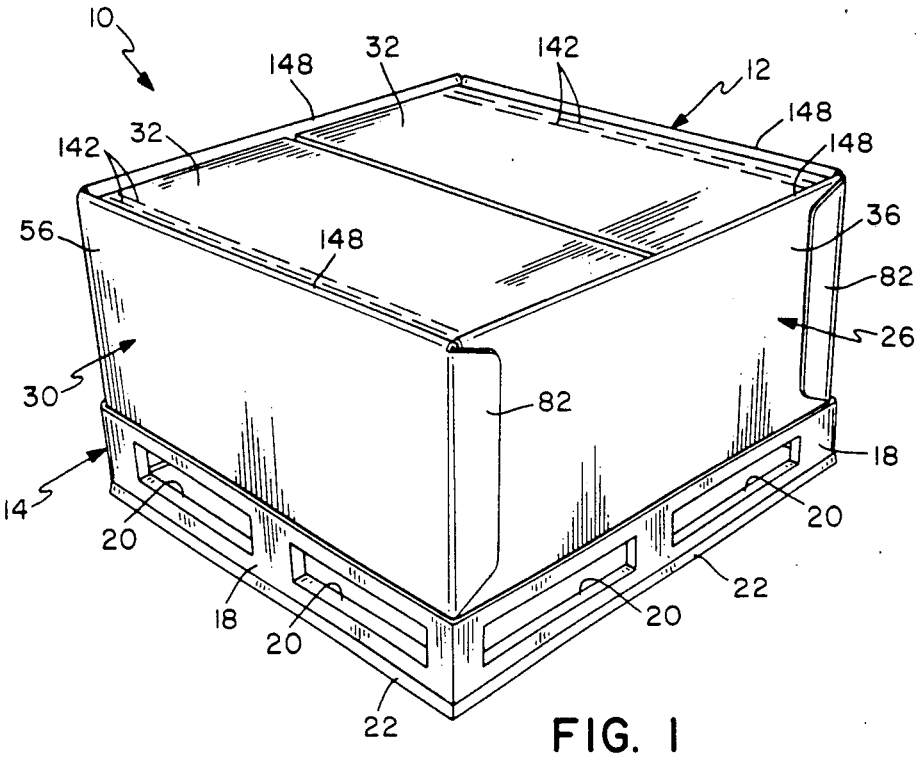
FIG. 1 is a perspective view of the collapsible container and pallet assembly of this invention in the upright container configuration with the lid flaps in the closed position.
Figure 2:
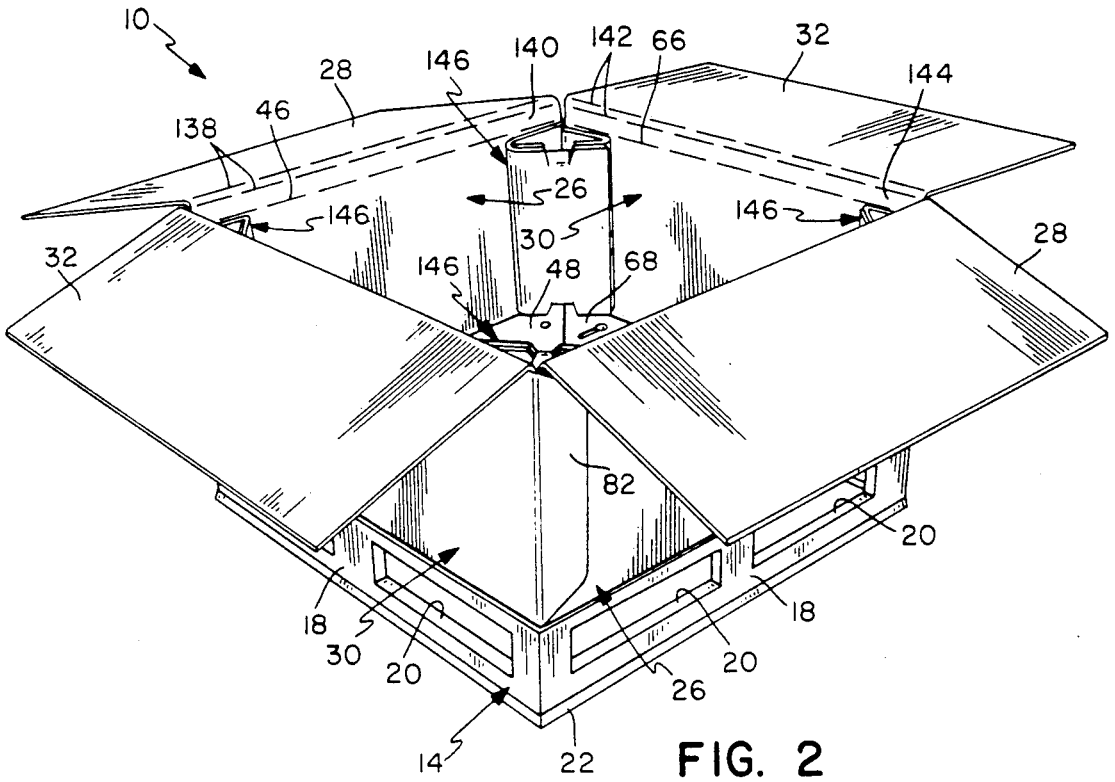
FIG. 2 is a perspective view of the collapsible container and pallet assembly of FIG. 1 with the lid flaps open.

Referring particularly to FIGS. 1 and 2, it may be seen that the collapsible container and pallet assembly 10 is comprised of an upper container 12 attached to a lower pallet 14. When constructed as described below, the upper container 12 will have a weight of approximately 19 lbs. (8.6 kg.) and the lower pallet 14 will weigh approximately 43 lbs. (19.5 kg.), the container and pallet assembly 10 being able to withstand a vertical drop to a hard surface of approximately 10' (3 m.) in any direction or orientation with minimal or no damage sustained.

Figure 8:
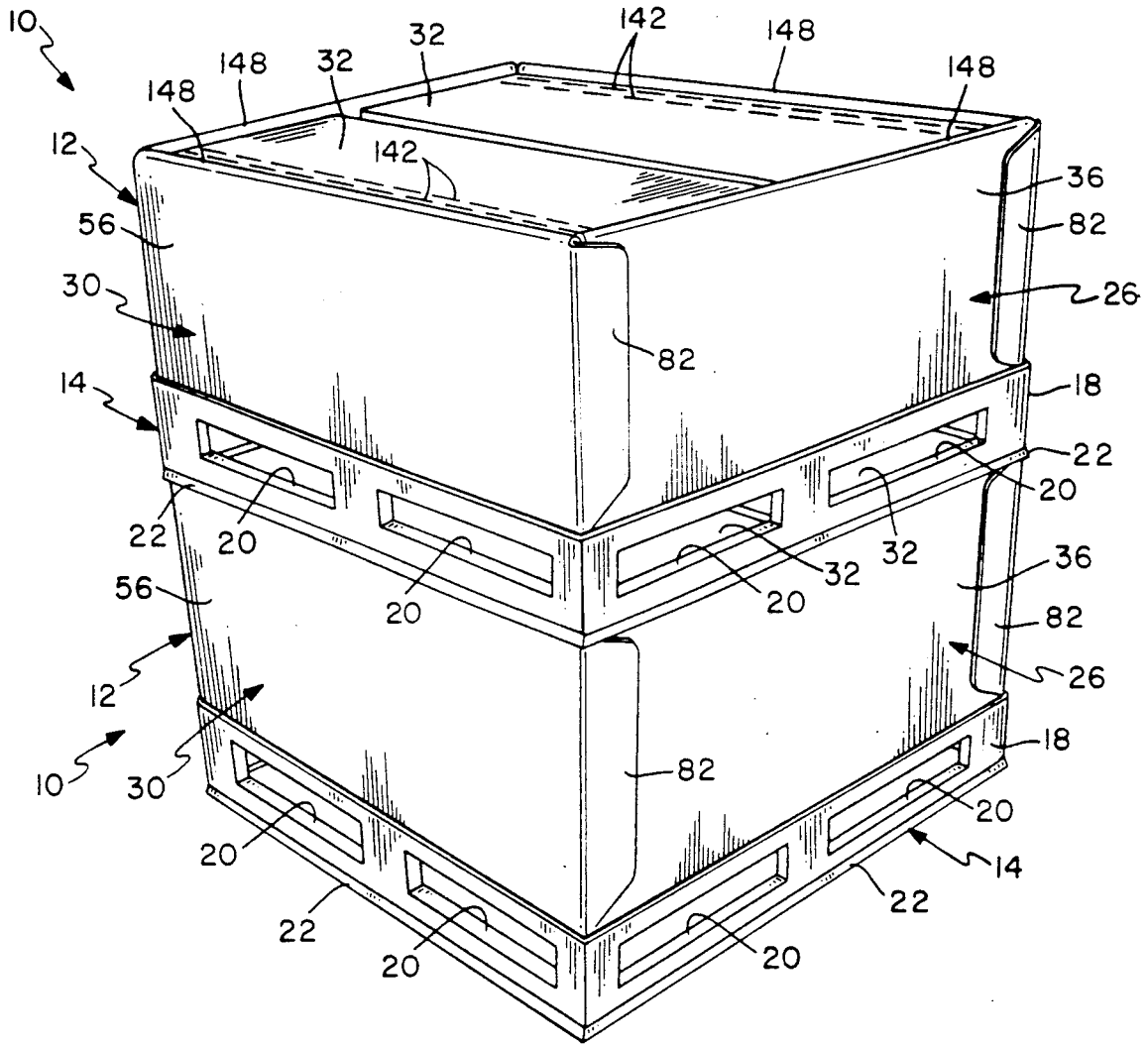
FIG. 8 is a perspective view of the container and pallet assembly of FIG. 1 with a like container and pallet assembly stacked thereon.
Figure 11:
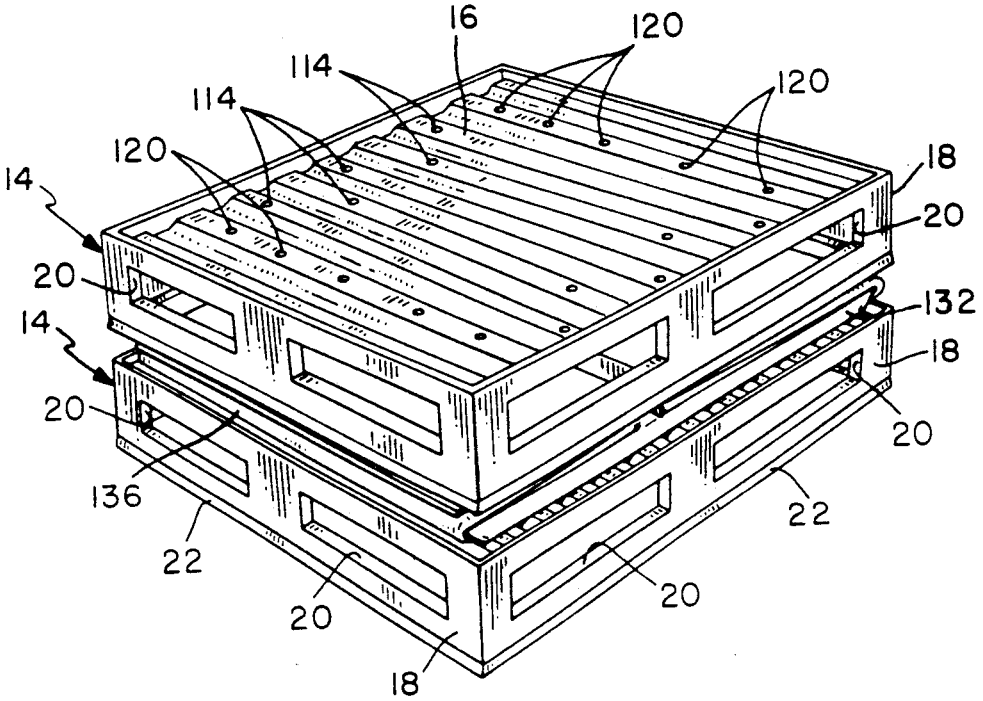
FIG. 11 is a perspective view of the container and pallet assembly of FIG. 1 folded to the stored configuration with a like pallet disposed thereabove.

It should be noted that the description of the upper container 12 and lower pallet 14 applies equally to one or several like collapsible container and pallet assemblies 10 which may be stacked on top of the collapsible container and pallet assembly 10 to form a generally vertical column as shown in FIGS. 8 and 11.

Figure 7:
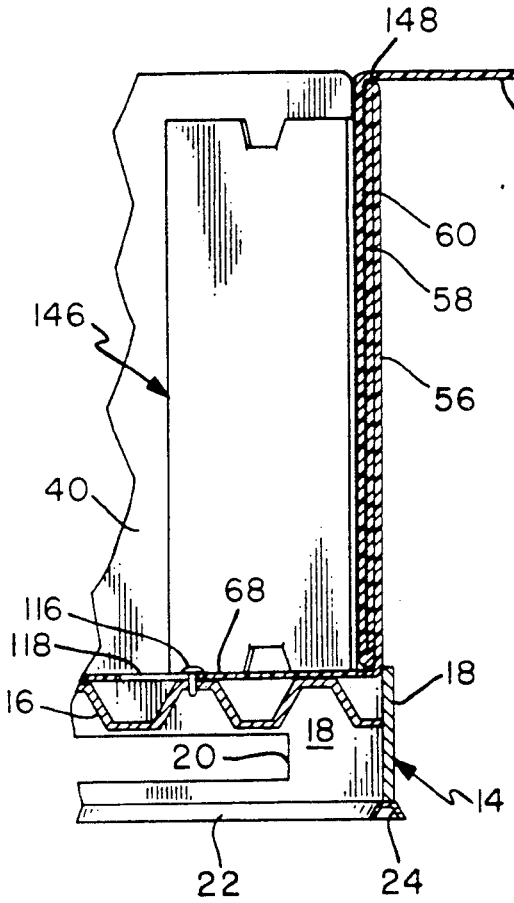
FIG. 7 is a cross section view taken through line 7—7 of FIG. 4 showing the end wall and pallet.

Referring to FIGS. 1, 7, and 11, it may be seen that the pallet 14 is generally rectangular and has a pair of opposing sides and a pair of opposing ends oriented generally perpendicularly to one another. The pallet 14 is constructed from sections of flat and corrugated sheet metal, and includes a corrugated top section 16, four generally vertical side walls 18 each defining a pair of generally rectangular openings 20 sized and spaced apart to receive a pair of conventional forklift forks (not shown) therein, and a generally planar bottom section 22. As shown particularly in FIGS. 7 and 7A, the bottom section 22 of the pallet 14 forms an inverted, U-shaped channel 24 which extends around the bottom peripheral edge of the pallet 14.

Figure 12:
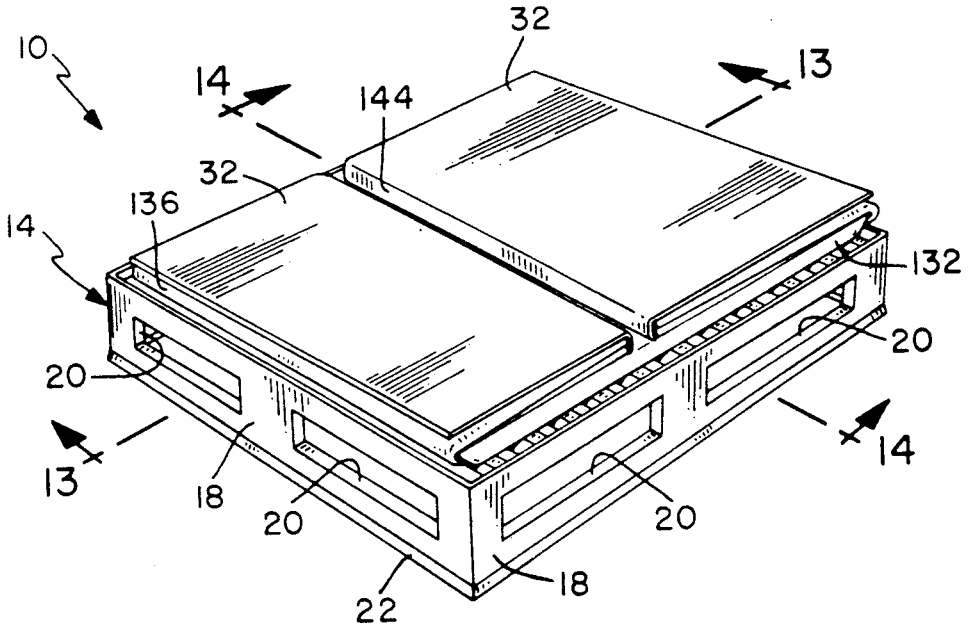
FIG. 12 is a perspective view of the container and pallet assembly of FIG. 1 folded to the stored configuration.

Referring again to FIGS. 1 and 2, it may be seen that the upper container 12 is comprised of a pair of opposing side walls 26 and associated side lid flaps 28, and a pair of opposing end walls 30 and associated end lid flaps 32, which are hingedly mounted on the pallet 14 proximate to and along the opposing sides and ends of the pallet 14, and which may be pivoted between an upright container configuration defining a receptacle region and a completely collapsed stored configuration as shown in FIG. 12.

Figure 15:
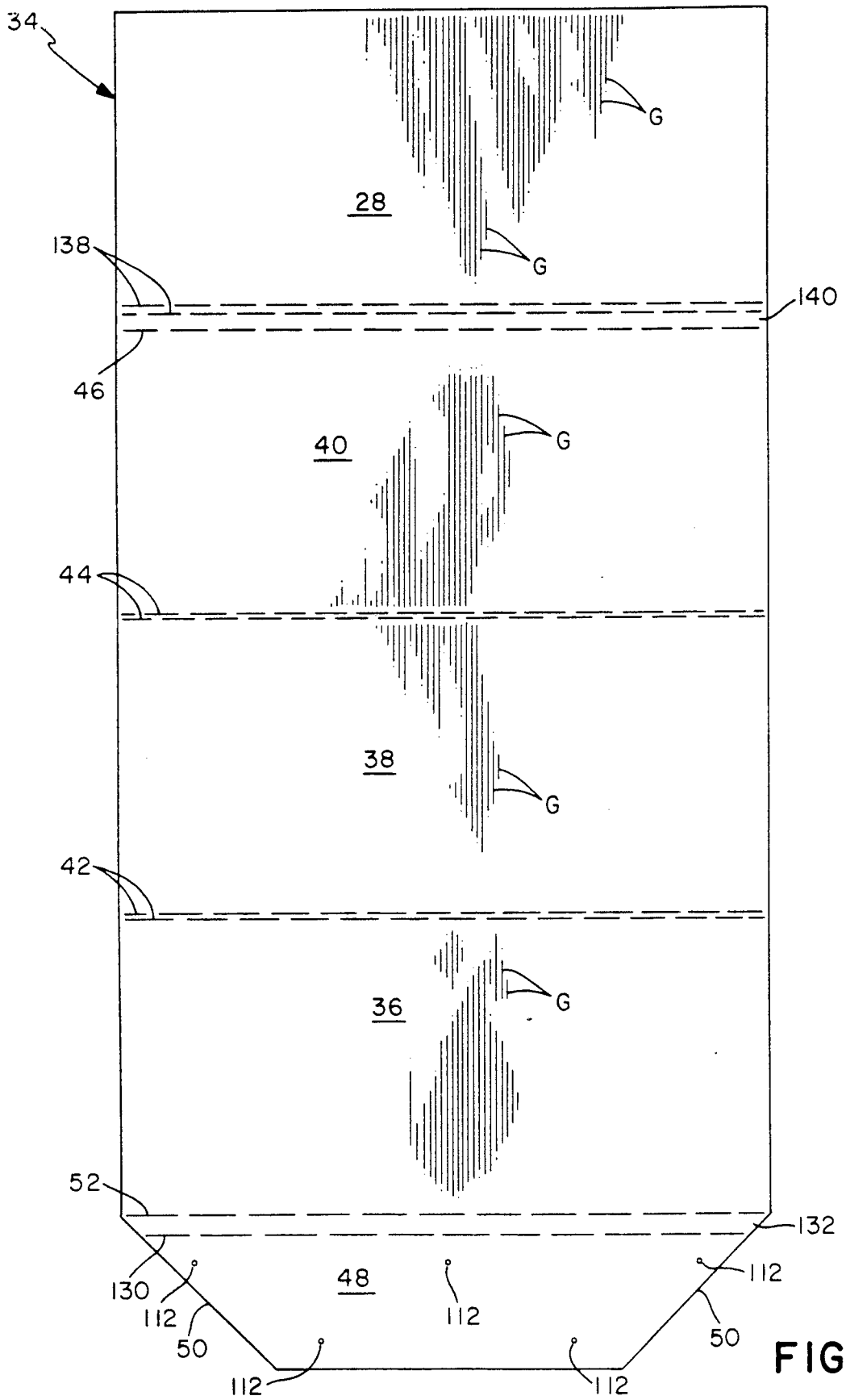
FIG. 15 is a top plan view of the blank used to form the side wall panels and associated lid flap.

Each side wall 26 and associated side lid flap 28 is formed from an integral side blank 34 as shown in FIG. 15, the side blank 34 preferably being cut and scored from a sheet of double-faced corrugated polyethylene defining a longitudinal grain G and a thickness. Each side blank 34 is comprised of a generally rectangular first or outer side wall panel 36, a generally rectangular second or intermediate side wall panel 38, and a generally rectangular third or inner side wall panel 40. The second or intermediate side wall panel 38 extends from and is hingedly connected to the top edge of the first or outer side wall panel 36 along double-scored fold lines 42, and similarly the third or inner side wall panel 40 extends from and is hingedly connected to the bottom edge of the second or intermediate side wall panel 38 along double-scored fold lines 44. The associated side lid flap 28 extends from and is hingedly connected to the top edge of the third or inner side wall panel 40 along a single-scored fold line 46. Extending from and hingedly connected to the bottom edge of the first or outer side wall panel 36 is a side wall attachment panel 48 having a pair of opposing angled 45° side edges 50, the attachment panel 48 being hingedly connected to the first or outer side wall panel 36 along a single-scored fold line 52.

Figure 16:
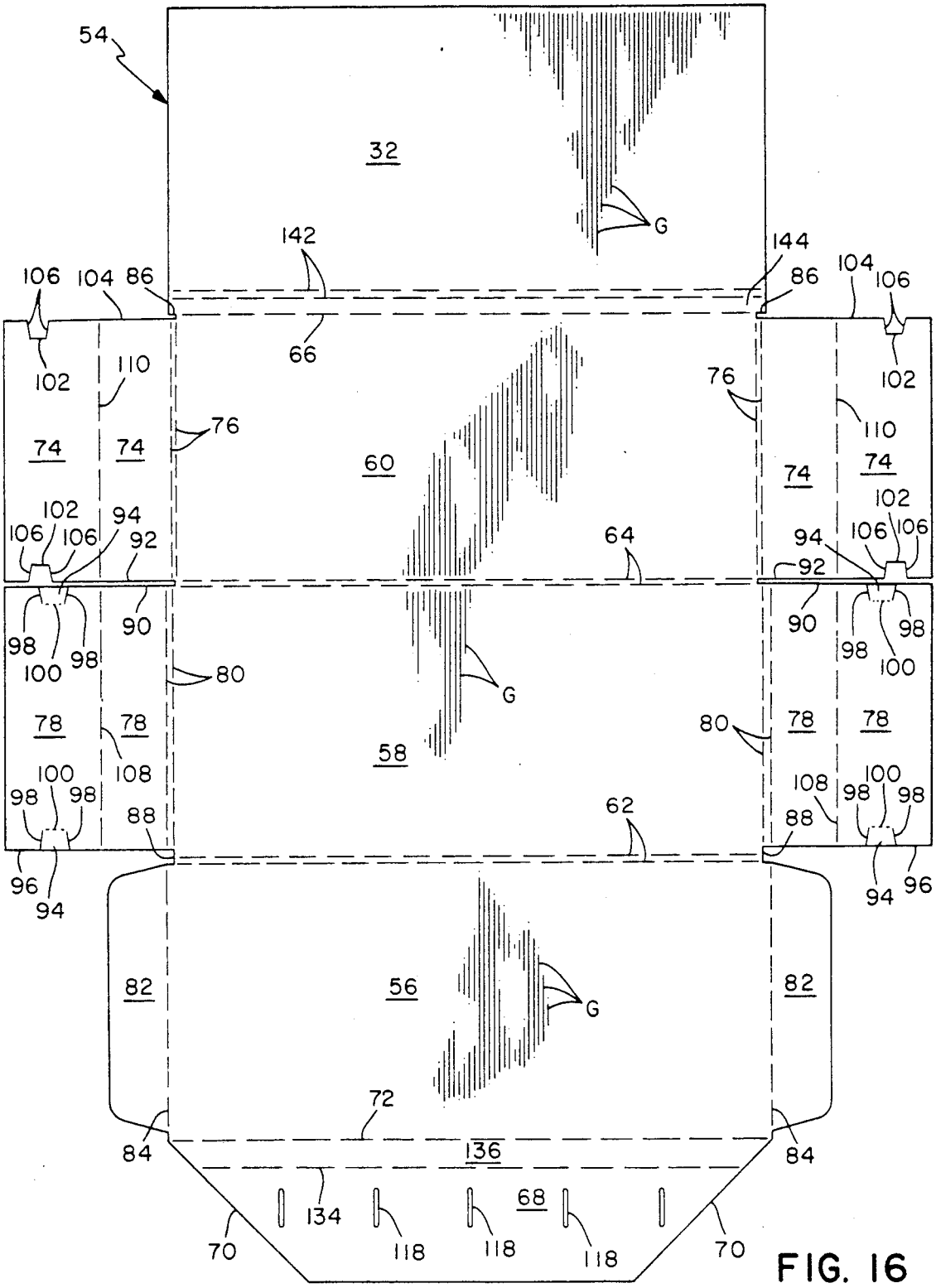
FIG. 16 is a top plan view of the blank used to form the end wall panels and associated lid flap.

Each end wall 30 and associated end lid flap 32 is formed from an integral end blank 54 as shown in FIG. 16, the end blank 54 preferably being cut and scored from a sheet of double-faced corrugated polyethylene defining a longitudinal grain G and a thickness similar to the side blank 34. Each end blank 54 is comprised of a generally rectangular first or outer end wall panel 56, a generally rectangular second or intermediate end wall panel 58, and a generally rectangular third or inner end wall panel 60. The second or intermediate end wall panel 58 extends from and is hingedly connected to the top edge of the first or outer end wall panel 56 along double-scored fold lines 62, and similarly the third or inner end wall panel 60 extends from and is hingedly connected to the bottom edge of the second or intermediate end wall panel 58 along double-scored fold lines 64. The associated end lid flap 32 extends from and is hingedly connected to the top edge of the third or inner end wall panel 60 along a single-scored fold line 66. Extending from and hingedly connected to the bottom edge of the first or outer end wall panel 56 is a end wall attachment panel 68 having a pair of opposing angled 45 side edges 70, the attachment panel 68 being hingedly connected to the first or outer end wall panel 56 along a single-scored fold line 72.

Referring again to FIG. 16, it may be seen that each of the end blanks 54 further include a pair of first or interior reinforcing corner panels 74 extending from and hingedly connected to the side edges of the third or inner end wall panels 60 along double-scored fold lines 76. Similarly, extending from and hingedly connected to the side edges of the second or intermediate end wall panels 58 are a pair of second or exterior reinforcing corner panels 78, each exterior reinforcing corner panel 78 being hingedly connected to the second or intermediate end wall panel 58 along a double-scored fold line 80. Each of the pair of double-scored fold lines 80 are spaced apart a distance approximately equal to the distance the adjacent double-scored fold lines 76 are spaced apart plus the thickness of the blank 54.

Extending from and hingedly connected to the side edges of each first or outer end wall panel 56 is a corner overlay panel 82, each corner overlay panel 82 being hingedly connected to first or outer end wall panel 56 along a single-scored fold line 84.

Referring to FIG. 15, it may be seen that the first or outer end wall panels 56, second or intermediate end wall panels 58, third or inner end wall panels 60, and the associated side lid flaps 28 each have approximately equal lengths defined by and extending between the side edges of the blank 34.

Referring to FIG. 16, it may be seen that the first or outer end wall panels 56 have a length defined by and measured between the single scored fold lines 84 along which the corner overlay panels 82 are hingedly connected. The second or intermediate end wall panels 58 have a length defined by and measured between the outer of the double scored fold lines 80 along which the exterior reinforcing corner panels 78 are hingedly connected, the lengths of each of the second or intermediate end wall panels 58 being approximately equal to the lengths of the first or outer end wall panels 56. The third or inner end wall panels 60 have a length defined by and measured between the outer of the double scored fold lines 76 along which the interior reinforcing corner panels 74 are hingedly connected, the lengths of each of the third or inner end wall panels 60 being slightly less than the lengths of the second or intermediate end wall panels 58, with the lengths of the third or inner end wall panels 60 being approximately equal to the distance between the inner pair of the double scored fold lines 80 along which the exterior reinforcing corner panels 78 are hingedly connected to the second or intermediate end wall panels 58. The end lid flaps 32 each have a length defined by and measured between the side edges thereof, the lengths of the end lid flaps 32 being slightly greater than the lengths of the associated or corresponding third or inner end wall panels 60, but less than the lengths of the associated or corresponding second or intermediate end wall panels 58.

Consequently, as may be seen in FIG. 16, a pair of narrow counter notches 86 are formed on each opposing side edge of the end blanks 54 between the corresponding end lid panels 32 and third or inner end wall panels 60, and a pair of wider counter notches 88 are formed on each opposing side edge of the end blanks 54 between the corresponding first or outer end wall panels 56 and second or intermediate end wall panels 58, thereby separating each of the corner overlay panels 82 from the adjacent exterior reinforcing corner panels 78. Conversely, the bottom edge 90 of each exterior reinforcing corner panel 78 is spaced apart from the top edge 92 of the closely adjacent interior reinforcing corner panel 74 a distance equal to the spacing or width of the double-scored fold lines 64 along which the associated second or intermediate end wall panel 58 and the third or inner end wall panel 60 are hingedly connected.

Each of the exterior reinforcing corner panels 78 defines a pair locking tabs 94 positioned along the bottom edge 90 and top edge 96 thereof, each locking tab 94 having a pair of tapered or angled side cuts 98 extending entirely through the surface of the exterior reinforcing corner panel 78, and being hingedly connected to the exterior reinforcing corner panel 78 by an un-scored or single-scored fold line 100. Each of the pair of locking tabs 94 are generally aligned with one another and are spaced equally from the corresponding outer side edge of the exterior reinforcing corner panel 78.

Each of the interior reinforcing corner panels 74 defines a pair locking notches 102 positioned along the bottom edge 92 and top edge 104 thereof, each locking notch 102 having a pair of tapered or angled side cuts 106 extending entirely through the surface of the interior reinforcing corner panel 74 at approximately the same angle as the side cuts 98 of the locking tabs 94 defined by the adjacent exterior reinforcing corner panels 78. Each of the pair of locking notches 102 are generally aligned with one another and are spaced equally from the corresponding outer side edge of the interior reinforcing corner panel 74. The distance between the outer side edge of the interior reinforcing corner panel 74 and the corresponding locking notches 102 is less than the distance between the outer side edge of the exterior reinforcing corner panel 78 and the corresponding locking tabs 94 by approximately the difference in lengths between the associated second or intermediate end wall panel 58 and corresponding third or inner end wall panel 60.

Each of the exterior reinforcing corner panels 78 and interior reinforcing corner panels 74 define central single-scored spacing fold line 108, 110, respectively, the spacing fold lines 108, 110 extending generally parallel with the corresponding side edges and double-scored fold lines 76, 80 of the exterior reinforcing corner panels 78 and interior reinforcing corner panels 74 and generally aligned with the adjacent spacing fold line 110, 108, respectively.

Figures 9, 10:
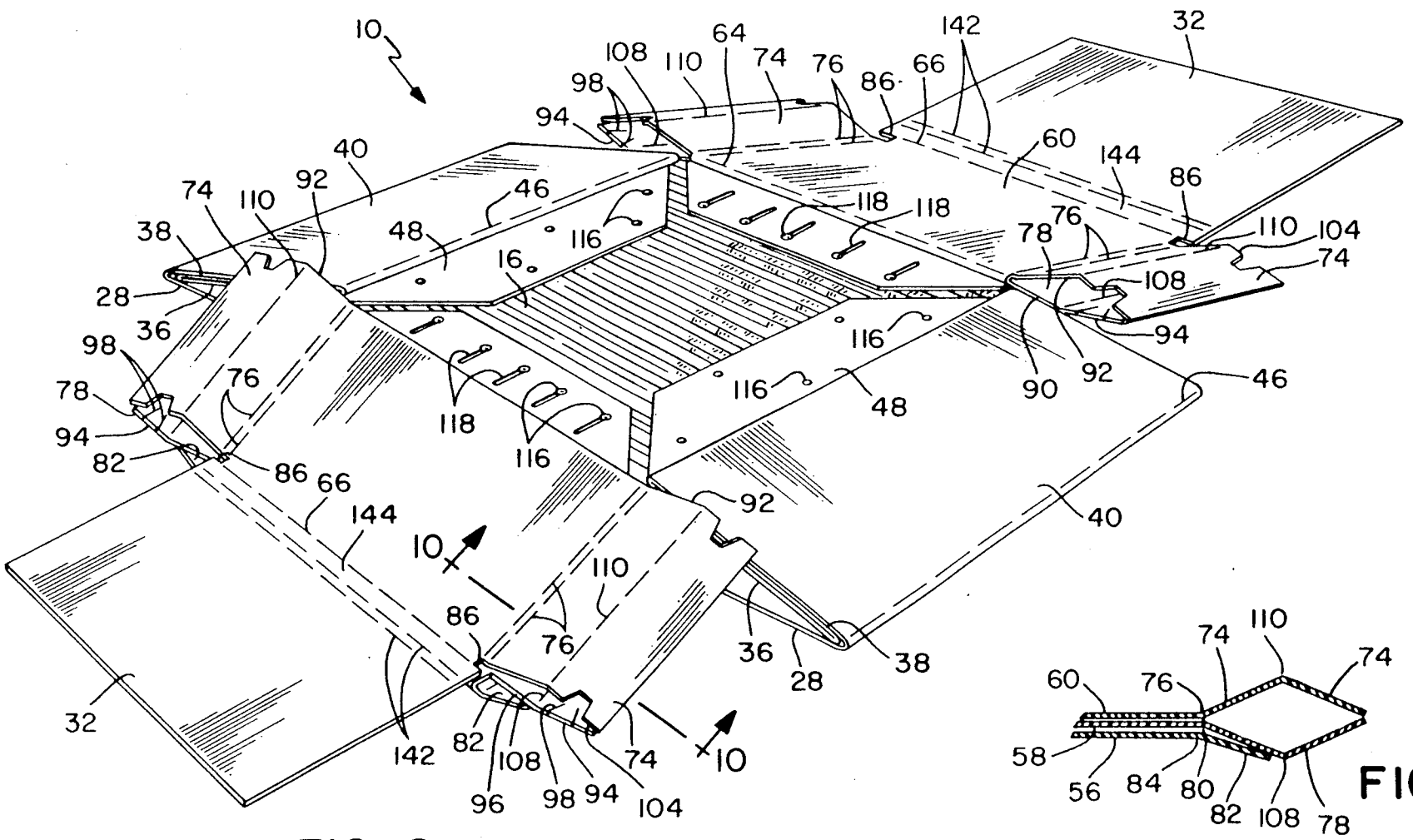
FIG. 9 is a perspective view of the container and pallet assembly of FIG. 1 with both side walls and both end walls unfolded.
FIG. 10 is a cross section view taken through line 10—10 of FIG. 9 showing the upright reinforcing corner unfolded.

Referring to FIGS. 9, 11, and 15, it may be seen that each of the side wall attachment panels 48 defines a plurality of generally circular attachment apertures 112 extending entirely through the surface thereof, the attachment apertures 112 being positioned or arranged in a staggered array. The corrugated top section 16 of the lower pallet 14 similarly defines two sets of side wall mounting apertures 114 extending entirely therethrough, the side wall mounting apertures 114 being positioned along the opposing sides of the lower pallet 14 and each corresponding to a point centered on the top planar surfaces of one of the upwardly projecting ridges of the corrugated top section 16, the sets of side wall mounting apertures 114 being aligned with the circular attachment apertures 112 of the corresponding side wall attachment panels 48 when the side wall blanks 34 are attached to and mounted on the lower pallet 14 as shown in FIG. 9.

Figure 3:
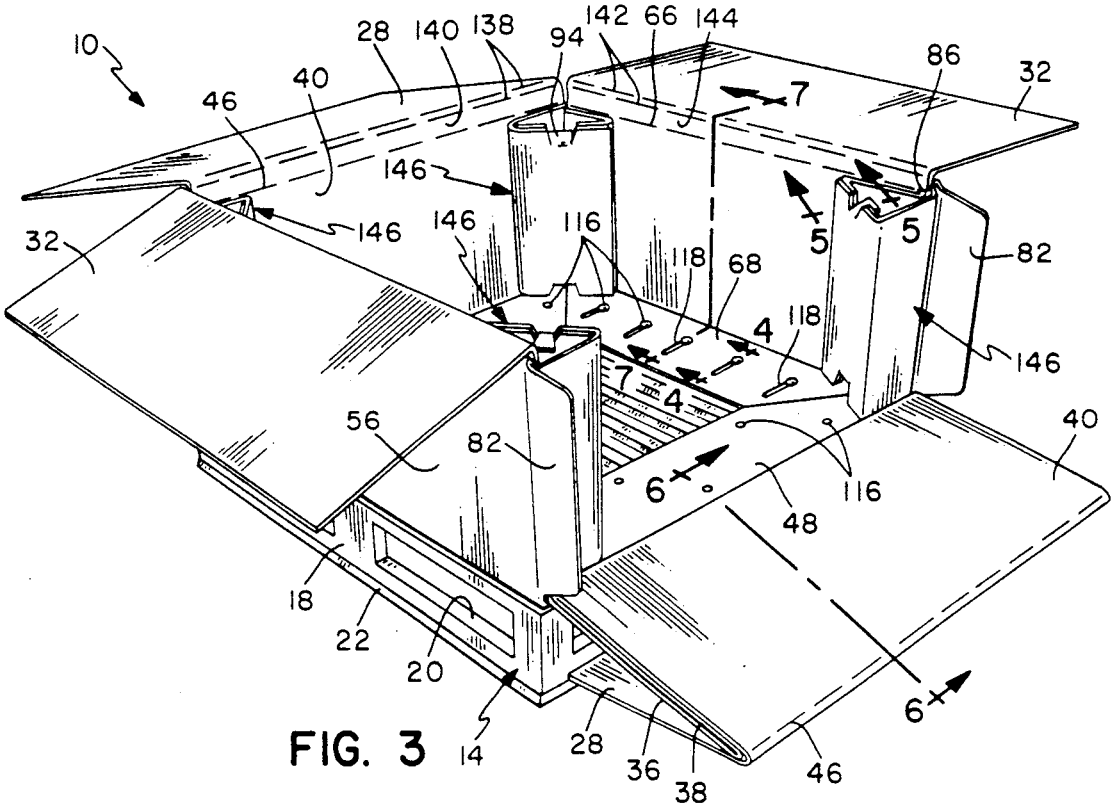
FIG. 3 is a perspective view of the collapsible container and pallet assembly of FIG. 1 showing one side wall unfolded.
Figure 6:
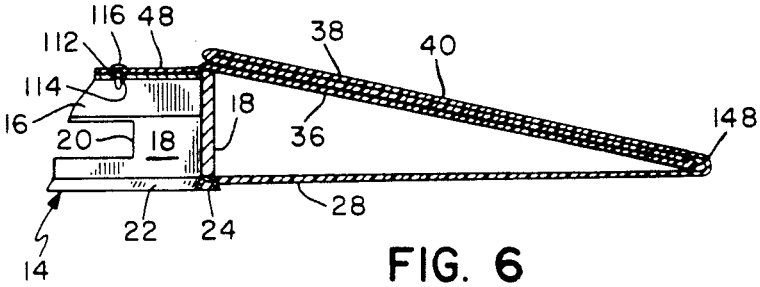
FIG. 6 is a cross section view taken through line 6—6 of FIG. 4 showing the side wall and associated lid panel.

Referring to FIGS. 3 and 6, it may be seen that the side wall blanks 34 are each fixedly attached to and securely mounted on the lower pallet 14 using push-type fasteners 116 which are forcibly inserted and extend through both the circular attachment apertures 112 of the side wall attachment panels 48 and the side wall mounting apertures 114 of the corrugated top section 16 of the lower pallet 14 from above.

Referring to FIGS. 3, 9, 11, and 16, it may be seen that each of the end wall attachment panels 68 defines a plurality of narrow, elongated attachment slots 118 extending entirely through the surface thereof and oriented generally perpendicular to the end edges of the pallet 14 and the inner edge of the end wall attachment panel 68. The attachment slots 118 are positioned or arranged in a generally straight row parallel with the single-scored fold line 72 defining the edge of the end wall attachment panels 68. The corrugated top section 16 of the lower pallet 14 similarly defines two sets of end wall mounting apertures 120 extending entirely therethrough, the end wall mounting apertures 120 being positioned along the opposing ends of the lower pallet 14 and each corresponding to a point centered on the top planar surfaces of one of the upwardly projecting ridges of the corrugated top section 16, the sets of end wall mounting apertures 120 similarly being positioned in two rows along opposing ends of the lower pallet 14 and each being aligned with at least a portion of one of the elongated attachment slots 118 of the corresponding end wall attachment panels 68 when the end wall blanks 54 are slidably attached to and mounted on the lower pallet 14 as shown in FIG. 9.

Figure 4:
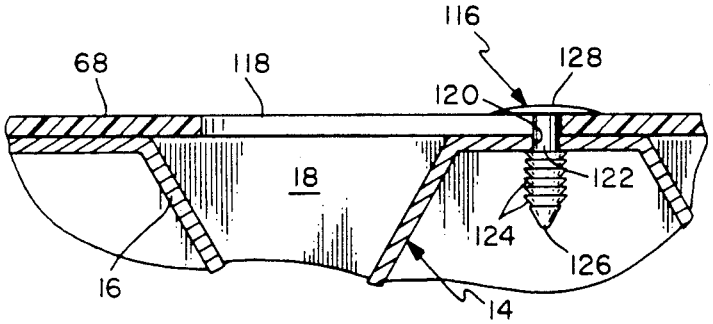
FIG. 4 is a cross section view taken through line 4—4 of FIG. 4 showing the fastening means to attach the end walls and side walls to the pallet.

Referring to FIGS. 3 and 4, it may be seen that the end wall blanks 54 are each slidably attached to and securely mounted on the lower pallet 14 using push-type fasteners 116 which are forcibly inserted and extend through both the attachment slots 118 of the end wall attachment panels 68 and the end wall mounting apertures 120 of the corrugated top section 16 of the lower pallet 14 from above. The push-type fasteners 116 or "christmas-tree" fasteners are similar to those used to fixedly mount the side wall blanks 34 to the lower pallet 14, but may be modified slightly for use in slidably mounting the end wall blanks 54. Referring to FIG. 4, the push-type fasteners 116 are molded from a compressible but resilient plastic, and are seen to include a shaft segment 122 defining a plurality or thin, flexible annular barbs or ribs 124 angled rearwardly or upwardly along the shaft 122, and a sharply rounded or pointed end 126. Opposing the pointed end 126 and integrally formed on the shaft segment 122 is a large, generally circular flat cap 128 which restricts passage of the fasteners 116 completely through the attachment slots 118 or attachment apertures 112.

The shaft segment 122 of each fastener 116 has a diameter approximately equal to but slightly less than the diameter of the attachment apertures 112, and less than the width of the attachment slots 118. The annular ribs 124 extend outwardly from the shaft segment 122 sufficiently that when the fasteners 116 are forcibly pressed sequentially through the attachment panels 48 and corrugated top segment 14, the rear edges of the annular ribs 124 will press outwardly and securely engage the adjacent section of the attachment panel 48 or corrugated top segment 14, and thereby prevent the fasteners 116 from being withdrawn from the attachment panel 48 and corrugated top segment 14. In the case of fasteners 116 used to movably or slidably mount the end blanks 54 to the lower pallet 14, the portion of the shaft segment 122 directly adjacent to the top cap 128 is burnished or routed to define a ribless section as shown in FIG. 4. This ribless section of the shaft segment 122 is horizontally aligned and coextensive with the thickness of the end wall attachment panels 48 such that the end blanks 54 may be moved slidably relative to the lower pallet 14 in a direction generally perpendicular to the opposing ends of the pallet 14 without the annular ribs 124 binding within the attachment slots 118.

Referring particularly to FIGS. 12–15, it may be seen that the side wall attachment panels 48 each have a single-scored fold line 130 defining a generally rectangular, laterally-oriented side spacing strip 132 adjacent to and parallel with the single-scored fold line 52 along which the first or outer side wall panels 36 are connected to the side wall attachment panels 48.

The side edges of the side spacing strips 132 are angled corresponding to the angled side edges 50 of the side attachment panels 48, with the maximum length of the spacing strip 132 being equal to the length of the corresponding first or outer side wall panel 36. Each side spacing strip 132 has a width measured between the single-scored fold line 130 and the single-scored fold line 52, that width being generally equal to or greater than three to five times the thickness of the corrugated plastic sheet material used to form the side wall blank 34, as may be seen in FIGS. 14 and 15.

Referring particularly to FIGS. 12–14 and 16, it may similarly be seen that the end wall attachment panels 68 each have a single-scored fold line 134 defining a generally rectangular, laterally-oriented end spacing strip 136 adjacent to and parallel with the single-scored fold line 72 along which the first or outer end wall panels 56 are connected to the side wall attachment panels 68.

The side edges of the end spacing strips 136 are angled corresponding to the angled side edges 70 of the end attachment panels 68, with the maximum length of the spacing strip 136 being equal to the length of the corresponding first or outer end wall panel 56. Each side spacing strip 136 has a width measured between the single-scored fold line 134 and the single-scored fold line 72, that width being generally equal to or greater than nine times the thickness of the corrugated plastic sheet material used to form the end wall blank 54, as may be seen in FIGS. 13 and 16.

Referring again to FIGS. 12, 13 and 15, it may be seen that each of the side lid flaps 28 includes double-scored fold lines 138 extending generally parallel to the single scored fold line 46 and defining a generally rectangular, laterally-oriented side lid flap reverse-fold strip 140, each side lid flap reverse-fold strip 140 having a length measured between the side edges equal to the length of the side lid flaps 28, and a width generally equal to or greater than four times the thickness of the corrugated plastic sheet material used to form the side wall blank 34.

Referring again to FIGS. 12, 14 and 16, it may be seen that each of the end lid flaps 32 includes double-scored fold lines 142 extending generally parallel to the single scored fold line 66 and defining a generally rectangular, laterally-oriented end lid flap reverse-fold strip 144, each end lid flap reverse-fold strip 144 having a length measured between the side edges equal to the length of the end lid flaps 32, and a width generally equal to or greater than five times the thickness of the corrugated plastic sheet material used to form the end wall blank 54.

Figure 7A:
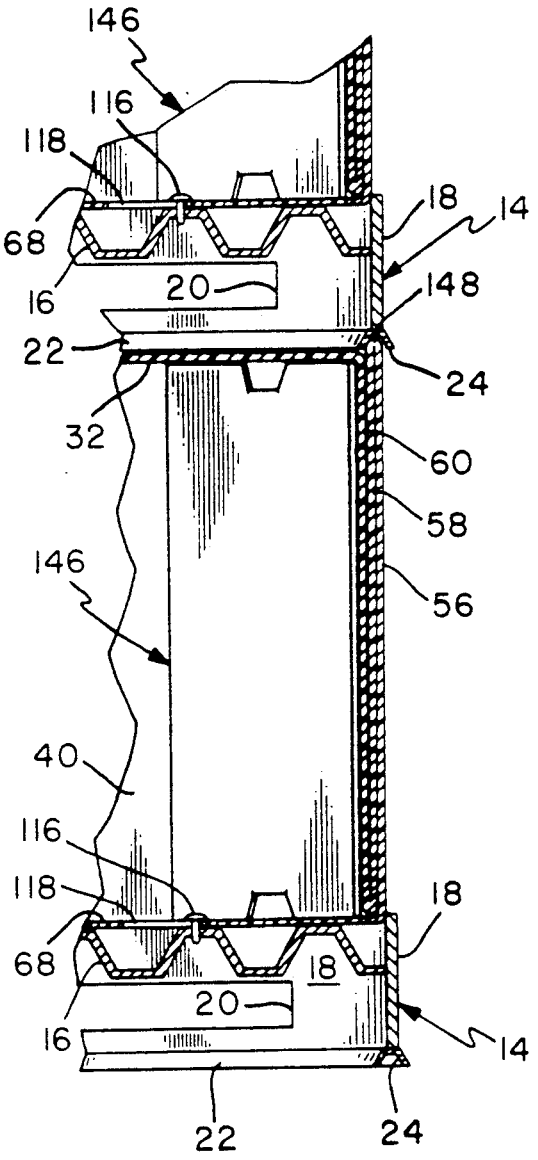
FIG. 7A is a cross section view taken through line 7—7 of FIG. 4 showing the end wall and pallet with a like container and pallet assembly stacked thereon.

In operation, the end walls 30 are each formed by folding the end blanks 54 into an upright end wall configuration, wherein the first or outer end wall panel 56 is upwardly folded across the single-scored fold line 72 and the second or intermediate end wall panel 58 is folded downwardly across double-scored fold lines 62 such that the inner planar surface of the first or outer end wall panel 56 contacts the outer planar surface of the second or intermediate end wall panel 58, and the third or outer end wall panel 60 is folded upwardly across double-scored fold lines 64 such that the inner planar surface of the second or intermediate end wall panel 58 contacts the outer planar surface of the third or inner end wall panel 60, with each of the first or outer end wall panel 56, second or intermediate end wall panel 58, and third or inner end wall panel 60 are positioned and oriented in a generally vertical and upright configuration, as shown in FIGS. 7 and 7A.

The inner planar surface of the first or outer end wall panel 56 may be fixedly or removably attached, connected, or bonded to the outer planar surface of the second or intermediate end wall panel 58, and the inner planar surface of the second or intermediate end wall panel 58 may be fixedly or removably attached or bonded to the outer planar surface of the third or inner end wall panel 60, using attachment means such as aligned and mating tabs or strips of Velcro hook-and-loop fasteners attached to each planar surface, stitching, sonic-welding, a suitable adhesive, or other conventional fastening means known to the art for securing or attaching plies of double-faced corrugated polyethylene to one another in generally planar abutting contact.

Figure 5:
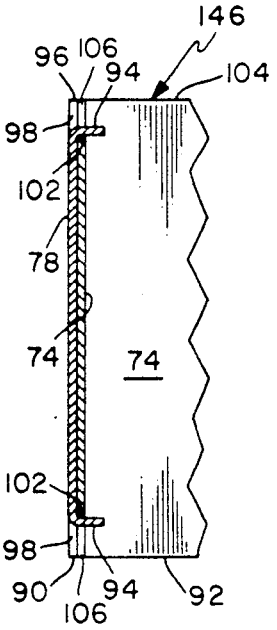
FIG. 5 is a cross section view taken through line 5—5 of FIG. 4 showing the upright reinforcing corner.

Referring to FIGS. 3, 5, 7, and 9–10, it may be seen that four generally upright, hollow columnar reinforcing structures 146 are formed from the first or interior reinforcing corner panels 74 and the second or exterior reinforcing corner panels 78 of the end wall blanks 54 proximate to the corners of the receptacle region, one upright reinforcing corner 146 being attached to and along each of the opposing sides of each of the end walls 30. The interior reinforcing corner panels 74 are each folded across the single-scored fold line 110 to form approximately a 60° angle, and the exterior reinforcing corner panels 78 are similarly folded across the single-scored fold line 108, with the outwardly facing surface of the exterior reinforcing corner panels 78 facing and closely confronting the inwardly facing and overlapping surface of the adjacent interior reinforcing corner panels 74 such that the locking tabs 94 each align with one of the locking notches 102, and the locking tabs 94 may each be bent or folded outwardly across single-scored fold line 100 and through the locking notches 102 such that the locking tabs 94 engage within the locking notches 102 as shown in FIG. 5, and secure the exterior reinforcing corner panels 78 to the interior reinforcing corner panels 74 to form the triangular upright reinforcing structures 146 as shown in FIGS. 2 and 3.

In a manner similar to the end walls 30, the side walls 26 are each formed by folding the side blanks 34 into an upright side wall configuration, wherein the first or outer side wall panel 36 is upwardly folded across the single-scored fold line 52 and the second or intermediate side wall panel 38 is folded downwardly across double-scored fold lines 42 such that the inner planar surface of the first or outer side wall panel 36 contacts the outer planar surface of the second or intermediate side wall panel 38, and the third or outer side wall panel 40 is folded upwardly across double-scored fold lines 44 such that the inner planar surface of the second or intermediate side wall panel 38 contacts the outer planar surface of the third or inner side wall panel 40, with each of the first or outer side wall panel 36, second or intermediate side wall panel 38, and third or inner side wall panel 40 are positioned and oriented in a generally vertical and upright configuration.

The inner planar surface of the first or outer side wall panel 36 may be fixedly or removably attached, connected, or bonded to the outer planar surface of the second or intermediate side wall panel 38, and the inner planar surface of the second or intermediate side wall panel 38 may be fixedly or removably attached or bonded to the outer planar surface of the third or inner side wall panel 40, using attachment means such as aligned and mating tabs or strips of Velcro hook-and-loop fasteners attached to each planar surface, stitching, sonic-welding, a suitable adhesive, or other conventional fastening means known to the art for securing or attaching plies of double-faced corrugated polyethylene to one another in generally planar abutting contact.

Referring particularly to FIGS. 1, 2, 3, 9, and 12, it may be seen that the collapsible container and pallet assembly 10 may be selectively and alternately folded between an upright container configuration as shown in FIG. 1 and a completely collapsed, stored configuration as shown in FIG. 12.

In the completely upright container configuration shown in FIG. 1, each of the side walls 26 and end walls 30 are folded to a generally upright vertical orientation, with the reinforcing structures 146 closely confronting and abutting the inner planer surfaces of both the first or inner side wall panels 36 and the first or inner end wall panels 56, and with each of the corner overlay panels 82 folded across single-scored fold lines 84 to form a generally right-angle and secured to the outer planar surface of the adjacent third or outer side wall panels 40. Each corner overlay panel 82 may be detachably or removably and selectively secured to the outer planar surface of the adjacent third or outer side wall panel 40 using aligned and mating tabs or strips of Velcro hook-and-loop fasteners attached to each planar surface, or other suitable removable fastening means, to secure each of the end wall panels 30 to each of the side wall panels 26 at the corners thereof.

In the completely upright container configuration, the side lid flaps 28 and end lid flaps 32 are each folded inwardly and downwardly across single-scored fold lines 46, 66, respectively, the side lid flaps 28 being folded inwardly beneath the end lid flaps 32 and in planar abutting contact therewith. The lower planar surfaces of the end lid flaps 32 may be secured to the upper planar surface of the side lid flaps 28 using aligned and mating tabs or strips of Velcro hook-and-loop fasteners attached to each planar surface.

When the side lid flaps 28 and end lid flaps 32 are folded completely inwardly and downwardly in covering relation to the receptacle region formed in the upper container 12, the side lid flaps 28 may rest directly on the top edges 96, 104 of the interior reinforcing corner panels 74 and exterior reinforcing corner panels 78 forming the reinforcing structures 146, as shown particularly in FIG. 7A.

Referring to FIGS. 1 and 7A, it may also be seen that when the side lid flaps 28 and end lid flaps 32 are folded completely inwardly and downwardly to contact the reinforcing structures 146, the corresponding first or outer side wall panels 36 and second or intermediate side wall panels 38, as well as the first or outer end wall panels 56 and second or intermediate end wall panels 58, each project upwardly above the top edges of the third or inner side wall panels 40 and third or inner end wall panels 60 and the top planar surfaces of the end lid flaps 32, thereby forming four stacking shoulders 148 extending along the length of each side and end of the upper container 12. The stacking shoulders 148 are thereby spaced apart and positioned such that each stacking shoulder 148 is engagingly received within one of the inverted U-shaped channels 24 at the bottom section 22 of the like pallet 14 as shown in FIG. 7A when a like collapsible container and pallet assembly 10 is stacked on top of a collapsible container and pallet assembly 10 to form a generally vertical aligned column as shown in FIG. 8.

To sequentially unfold and refold the upper container 12 to the completely collapsed, stored configuration as shown in FIG. 12, it is first necessary to detach or disconnect each of the corner overlay panels 82 from the adjacent third or outer side wall panel 40, as shown in FIG. 3.

The side lid flaps 28 and end lid flaps 32 may be folded upwardly and outwardly across the double scored fold lines 138, 142, respectively, to dispose the side lid flap reverse-fold strip 140 and end lid flap reverse-fold strip 144 over and across the stacking shoulders, with the side lid flaps 28 and end lid flaps 32 being folded substantially toward or completely into contact with the outer surfaces of the corresponding first or outer side wall panels 40 and first or outer end wall panels 60 as shown in FIGS. 3, 6, and 13–14. The end lid flaps 32 may be removably secured parallel to the outer planar surface of the end wall panels 56 by folding the corner overlay panels 82 completely backward across the single-scored fold lines 84 and into contact with the outer planar surfaces of the first or outer end wall panels 56, and the end lid flaps 32 may be fastened to the corner overlay panels 82 using the tabs or strips of Velcro fastener attached to the corner overlay panels 82 and aligned and mating tabs or strips of Velcro fastener attached to each inner planar surface of the end lid flaps 32, as shown particularly in FIG. 13.

Once the side walls 26 and end walls 30 of the container 12 have been detached or unfastened and folded outwardly and downwardly to the position shown in FIG. 9, and the reinforcing structures 146 have been unfastened and folded flat as shown in FIGS. 9–10, the container 12 may then be folded to the completely collapsed, stored configuration of FIG. 12. In order to fold the side walls 26 and end walls 30 into the stored configuration of FIG. 12, the end walls 30 must be slidably moved outward away from the edges of the pallet 14 in a direction generally perpendicular to the ends of the pallet 14 until the push-type fasteners 116 reach the inner edge of the attachment slots 118, and the side walls 26 may then be folded inwardly across single-scored fold line 130 until the inner surface of the third or inner side wall panels 40 rest on top of the side attachment panels 48 and end attachment panels 68, as well as contacting the central region of the corrugated top section 16 of the pallet 14, as shown in FIGS. 13 and 14.

The interior reinforcing corner panels 74 and exterior reinforcing corner panels 78 may be folded backward and inwardly across double-scored fold lines 76 and 80, respectively, such that the interior reinforcing corner panels 74 contact and abut the inner planar surfaces of the third or inner end wall panels 60, and the exterior reinforcing corner panels 78 contact and abut the interior reinforcing corner panels 74. The end walls 30 may then be folded upwardly and inwardly until the end walls 30 rest on top of the side walls 26, and such that the interior reinforcing corner panels 74 and exterior reinforcing corner panels 78 are disposed between the third or inner end wall panels 60 and the side lid panels 28, as shown in FIG. 13.

Figure 13:
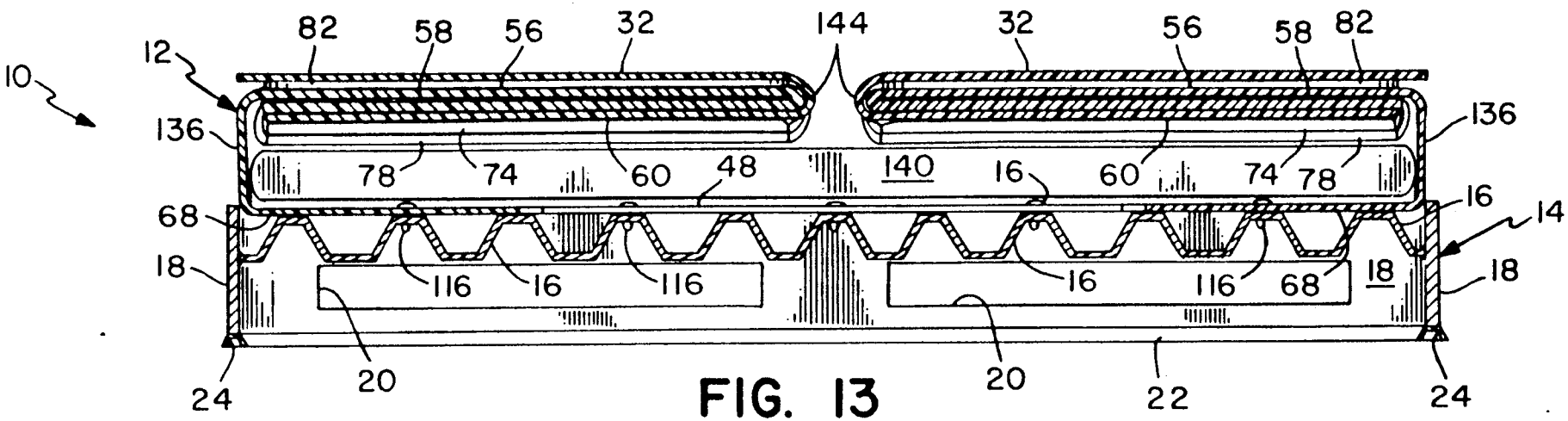
FIG. 13 is a cross section view taken through line 13—13 of FIG. 12 showing the panels of the end wall and associated lid flap folded to the stored configuration.
Figure 14:
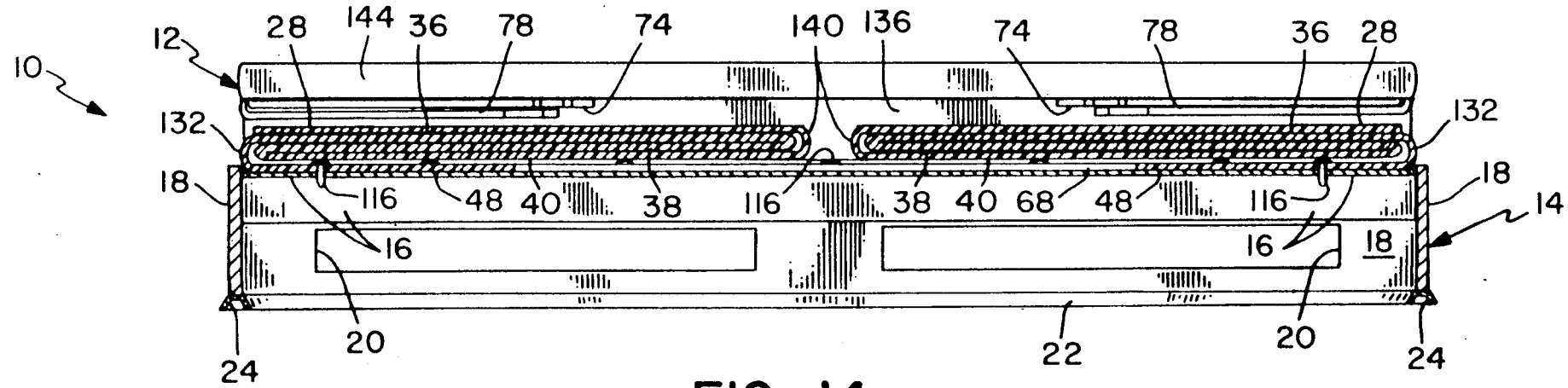
FIG. 14 is a cross section view taken through line 14—14 of FIG. 12 showing the panels of the side wall and associated lid flap folded to the stored configuration.

It may be seen that once the collapsible container and pallet assembly 10 is folded to the completely collapsed, stored configuration as shown in FIGS. 11 and 13–14, a like collapsible container and pallet assembly 10 similarly in the completely collapsed, stored configuration may be disposed above the collapsible container and pallet assembly 10 and lowered such that the container 12 of the lower collapsible container and pallet assembly 10 will be received within and be protected by the like pallet 14, the container 12 being located between the bottom sections 22 and inverted U-shaped channels 24 and beneath the corrugated top section 16. In this manner, the inverted U-shaped channels 24 rest on top of the bottom sections 22 of the pallet 14, and several like collapsible container and pallet assemblies 10 may be stacked in a generally vertical aligned column in the stored configuration.

While the preferred embodiment of the above collapsible container and pallet assembly 10 has been described in detail above with reference to the attached drawing figures, it is understood that various changes and adaptations may be made in the collapsible container and pallet assembly 10 without departing from the spirit and scope of the appended claims.

What is claimed is:

1. A collapsible container and pallet assembly comprising:

a pallet, said pallet having a pair of opposing sides and a pair of opposing ends;

a pair of side walls attached to and hingedly mounted on said pallet, one of said pair of side walls being positioned adjacent to each of said opposing sides of said pallet; and a pair of end walls attached to and hingedly mounted on said pallet, one of said pair of end walls being positioned adjacent to each of said opposing ends of said pallet, said side walls and said end walls being pivotally movable to and securable in an upright container configuration defining a receptacle region and being pivotally movable to a collapsed stored configuration, said pair of end walls being slidably attached to said pallet for movement inwardly and outwardly generally perpendicular to said ends of said pallet.

2. The container and pallet assembly of claim 1 wherein each of the pair of end walls comprises:

an outer end wall panel having an inner planar surface;

an intermediate end wall panel having an inner planar surface and an outer planar surface, said intermediate end wall panel being hingedly connected to said outer end wall panel and pivoted relative to said outer end wall panel such that said inner planar surface of said outer end wall panel is parallel with and closely adjacent to said outer surface of said intermediate end wall panel; and an inner end wall panel having an outer planar surface, said inner end wall panel being hingedly connected to said intermediate end wall panel and pivoted relative to said intermediate end wall panel such that said inner planar surface of said intermediate end wall panel is parallel with and closely adjacent to said outer surface of said inner end wall panel.

3. The container and pallet assembly of claim 2 wherein the outer end wall panels each have a bottom edge, the intermediate end wall panels each have a top edge and a bottom edge, and the inner end wall panels each have a top edge, the outer end wall panels extending from and being hingedly connected to the intermediate end wall panels along the top edges thereof, the inner end wall panels extending from and being hingedly connected to the intermediate end wall panels along the bottom edges thereof.

4. The container and pallet assembly of claim 3 wherein each of the end walls is cut from a sheet of generally planar sheet material and scored with a plurality of score lines to form a blank, said plurality of score lines defining the inner end wall panel, the intermediate end wall panel, and the outer end wall panel.

5. The container and pallet assembly of claim 2 wherein each of the end walls further comprises:

an end lid flap, said end lid flap being hingedly connected to the inner end wall panel, said end lid flap being pivotally movable between a closed position in covering relation to the receptacle region and an open position disposed from said closed position.

6. The container and pallet assembly of claim 5 wherein the inner end wall panel has a top edge, the end lid flap extending from and being hingedly connected to the inner end wall panel along said top edge thereof.

7. The container and pallet assembly of claim 5 wherein each of the end walls is cut from a sheet of generally planar sheet material and scored with a plurality of score lines to form a blank, said plurality of score lines defining the inner end wall panel, the intermediate end wall panel, and the outer end wall panel, and the end lid flap.

8. The container and pallet assembly of claim 1 wherein each of the outer end wall panels has a bottom edge, and each of the end walls further comprises:

an end wall attachment panel, said end wall attachment panel extending from and being hingedly connected to the outer end wall panel along the bottom edge thereof, said end wall attachment panel being slidably fastened to the pallet adjacent one of the opposing ends thereof.

9. The container and pallet assembly of claim 8 wherein the end wall attachment panels each define a plurality of spaced apart slots extending entirely therethrough, and wherein the pallet includes a top section defining a plurality of spaced apart apertures, each of said slots being aligned with one of said apertures when the end wall is mounted on the pallet, said assembly further comprising:

fastening means for securing each of the end walls to the pallet, said fastening means including a plurality of fasteners, each of said fasteners being received within and extending through one of the slots defined by the end wall attachment panel and through an aligned one of the apertures in the top section of the pallet.

10. The container and pallet assembly of claim 9 wherein the slots are generally elongated and are oriented generally perpendicular to the adjacent ends of the pallet.

11. The container and pallet assembly of claim 1 wherein each of the pair of side walls comprises:

an outer side wall panel having an inner planar surface;

an intermediate side wall panel having an inner planar surface and an outer planar surface, said intermediate side wall panel being hingedly connected to said outer side wall panel and pivoted relative to said outer side wall panel such that said inner planar surface of said outer side wall panel is parallel with and closely adjacent to said outer surface of said intermediate side wall panel; and an inner side wall panel having an outer planar surface, said inner side wall panel being hingedly connected to said intermediate side wall panel and pivoted relative to said intermediate side wall panel such that said inner planar surface of said intermediate side wall panel is parallel with and closely adjacent to said outer surface of said inner side wall panel.

12. The container and pallet assembly of claim 11 wherein the outer side wall panels each have a bottom edge, the intermediate side wall panels each have a top edge and a bottom edge, and the inner side wall panels each have a top edge, the outer side wall panels extending from and being hingedly connected to the intermediate side wall panels along the top edges thereof, the inner side wall panels extending from and being hingedly connected to the intermediate side wall panels along the bottom edges thereof.

13. The container and pallet assembly of claim 12 wherein each of the side walls is cut from a sheet of ge y planar sheet material and scored with a plurality of score lines to form a blank, said plurality of score lines defining the inner side wall panel, the intermediate side wall panel, and the outer side wall panel.

14. The container and pallet assembly of claim 11 wherein each of the side walls further comprises:

a side lid flap, said side lid flap being hingedly connected to the inner side wall panel, said side lid flap being pivotally movable between a closed position in covering relation to the receptacle region and an open position disposed from said closed position.

15. The container and pallet assembly of claim 14 wherein the inner side wall panel has a top edge, the side lid flap extending from and being hingedly connected to the inner side wall panel along said top edge thereof.

16. The container and pallet assembly of claim 14 wherein each of the side walls is cut from a sheet of generally planar sheet material and scored with a plurality of score lines to form a blank, said plurality of score lines defining the inner side wall panel, the intermediate side wall panel, and the outer side wall panel, and the side lid flap.

17. The container and pallet assembly of claim 1 wherein each of the outer side wall panels has a bottom edge, and each of the side walls further comprises:

a side wall attachment panel, said side wall attachment panel extending from and being hingedly connected to the outer side wall panel along the bottom edge thereof, said side wall attachment panel being fastened to the pallet adjacent one of the opposing ends thereof.

18. The container and pallet assembly of claim 1 wherein each of the pair of end walls includes an outer end wall panel, an intermediate end wall panel parallel with and closely adjacent to said outer end wall panel, and an inner end wall panel parallel with and closely adjacent to said intermediate end wall panel.

19. The container and pallet assembly of claim 18 wherein the outer end wall panel has an inner planar surface and the intermediate end wall panel has an outer planar surface, said inner planar surface of the outer end wall panel is fixedly attached to said outer planar surface of the intermediate end wall panel by an attachment means.

20. The container and pallet assembly of claim 19 wherein the attachment means comprises a plurality of sonic welds.

21. The container and pallet assembly of claim 18 wherein the outer end wall panel has an inner planar surface and the intermediate end wall panel has an outer planar surface, said inner planar surface of the outer end wall panel is removably attached to said outer planar surface of the intermediate end wall panel by an attachment means.

22. The container and pallet assembly of claim 21 wherein the attachment means comprises a plurality of aligned and mating sections of hook-and-loop fastener material attached to said outer planar surface and said inner planar surface.

23. The container and pallet assembly of claim 18 wherein the intermediate end wall panel has an inner planar surface and the inner end wall panel has an outer planar surface, said inner planar surface of the intermediate end wall panel is fixedly attached to said outer planar surface of the inner end wall panel by an attachment means.

24. The container and pallet assembly of claim 23 wherein the attachment means comprises a plurality of sonic welds.

25. The container and pallet assembly of claim 18 wherein the intermediate end wall panel has an inner planar surface and the inner end wall panel has an outer planar surface, said inner planar surface of the intermediate end wall panel is removably attached to said outer planar surface of the inner end wall panel by an attachment means.

26. The container and pallet assembly of claim 25 wherein the attachment means comprises a plurality of aligned and mating sections of hook-and-loop fastener material attached to said outer planar surface and said inner planar surface.

27. The container and pallet assembly of claim 1 wherein each of the pair of side walls includes an outer side wall panel, an intermediate side wall panel parallel with and closely adjacent to said outer side wall panel, and an inner side wall panel parallel with and closely adjacent to said intermediate side wall panel.

28. The container and pallet assembly of claim 27 wherein the outer side wall panel has an inner planar surface and the intermediate side wall panel has an outer planar surface, said inner planar surface of the outer side wall panel is fixedly attached to said outer planar surface of the intermediate side wall panel by an attachment means.

29. The container and pallet assembly of claim 28 wherein the attachment means comprises a plurality of sonic welds.

30. The container and pallet assembly of claim 27 wherein the outer side wall panel has an inner planar surface and the intermediate side wall panel has an outer planar surface, said inner planar surface of the outer side wall panel is removably attached to said outer planar surface of the intermediate side wall panel by an attachment means.

31. The container and pallet assembly of claim 30 wherein the attachment means comprises a plurality of aligned and mating sections of hook-and-loop fastener material attached to said outer planar surface and said inner planar surface.

32. The container and pallet assembly of claim 27 wherein the intermediate side wall panel has an inner planar surface and the inner side wall panel has an outer planar surface, said inner planar surface of the intermediate side wall panel is fixedly attached to said outer planar surface of the inner side wall panel by an attachment means.

33. The container and pallet assembly of claim 32 wherein the attachment means comprises a plurality of sonic welds.

34. The container and pallet assembly of claim 27 wherein the intermediate side wall panel has an inner planar surface and the inner side wall panel has an outer planar surface, said inner planar surface of the intermediate side wall panel is removably attached to said outer planar surface of the inner side wall panel by an attachment means.

35. The container and pallet assembly of claim 34 wherein the attachment means comprises a plurality of aligned and mating sections of hook-and-loop fastener material attached to said outer planar surface and said inner planar surface.

36. The container and pallet assembly of claim 1 wherein the pallet has a bottom section defining an inverted channel extending along each of the opposing ends thereof, and wherein each of the pair of end walls includes an outer end wall panel having a top edge, an intermediate end wall panel parallel with and closely adjacent to said outer end wall panel, said intermediate panel having a top edge, and an inner end wall panel parallel with and closely adjacent to said intermediate end wall panel, said inner end wall panel having a top edge, said top edge of the outer end wall panel and said top edge of the intermediate end wall panel extending upwardly above said top edge of the inner end wall panel.

37. The container and pallet assembly of claim 36 wherein a like container and pallet assembly may be selectively and removably stacked on top of the container and pallet assembly, the top edges of the outer end wall panel and the top edges of the intermediate end wall panel being at least partially received within the inverted channels of the pallet of the like container and pallet assembly.

38. The container and pallet assembly of claim 37 wherein each of the end walls further includes an end lid flap, each said end lid flap being hingedly connected to the top edge of the corresponding inner end wall panel, each said end lid flap being pivotally movable between a closed position in covering relation to the receptacle region and an open position disposed from said closed position, the top edge of the outer end wall panel and the top edge of the intermediate end wall panel extending upwardly above each said end lid flap when said end lid flaps are in said closed position thereby defining stacking shoulders extending along the top of each of the end walls.

39. The container and pallet assembly of claim 1 wherein the pallet has a bottom section defining an inverted channel extending along each of the opposing sides thereof, and wherein each of the pair of side walls includes an outer side wall panel having a top edge, an intermediate side wall panel parallel with and closely adjacent to said outer side wall panel, said intermediate panel having a top edge, and an inner side wall panel parallel with and closely adjacent to said intermediate side wall panel, said inner side wall panel having a top edge, said top edge of the outer side wall panel and said top edge of the intermediate side wall panel extending upwardly above said top edge of the inner side wall panel.

40. The container and pallet assembly of claim 39 wherein a like container and pallet assembly may be selectively and removably stacked on top of the container and pallet assembly, the top edges of the outer side wall panel and the top edges of the intermediate side wall panel being at least partially received within the inverted channels of the pallet of the like container and pallet assembly.

41. The container and pallet assembly of claim 40 wherein each of the side walls further includes a side lid flap, each said side lid flap being hingedly connected to the top edge of the corresponding inner side wall panel, each said side lid flap being pivotally movable between a closed position in covering relation to the receptacle region and an open position disposed from said closed position, the top edge of the outer side wall panel and the top edge of the intermediate side wall panel extending upwardly above each said side lid flap when said side lid flaps are in said closed position thereby defining stacking shoulders extending along the top of each of the side walls.

42. The container and pallet assembly of claim 1 wherein the pallet has a bottom section defining an inverted channel extending along each of the opposing ends thereof and each of the opposing sides thereof, and wherein each of the pair of end walls includes an outer end wall panel having a top edge, an intermediate end wall panel parallel with and closely adjacent to said outer end wall panel, said intermediate panel having a top edge, and an inner end wall panel parallel with and closely adjacent to said intermediate end wall panel, said inner end wall panel having a top edge, said top edge of the outer end wall panel and said top edge of the intermediate end wall panel extending upwardly above said top edge of the inner end wall panel, and wherein each of the pair of side walls includes an outer side wall panel having a top edge, an intermediate side wall panel parallel with and closely adjacent to said outer side wall panel, said intermediate panel having a top edge, and an inner side wall panel parallel with and closely adjacent to said intermediate side wall panel, said inner side wall panel having a top edge, said top edge of the outer side wall panel and said top edge of the intermediate side wall panel extending upwardly above said top edge of the inner side wall panel.

43. The container and pallet assembly of claim 42 wherein a like container and pallet assembly may be selectively and removably stacked on top of the container and pallet assembly, the top edges of each of the outer end wall panels, the intermediate end wall panels, the outer side wall panels, and the intermediate side wall panels being at least partially received within the inverted channels of the pallet of the like container and pallet assembly.

44. The container and pallet assembly of claim 1 wherein the pallet has a top section and a bottom section, said bottom section defining a bottom peripheral edge extending along the opposing ends and the opposing sides thereof, and wherein the end walls and the side walls may be pivoted inwardly and downwardly toward said top section of the pallet when the end walls and the side walls are in the collapsed stored configuration, the end walls and the side walls of the container and pallet assembly being received within the bottom peripheral edge of the bottom section of the pallet of a like container and pallet assembly when the like container and pallet assembly is stacked on top of the container and pallet assembly.

45. The container and pallet assembly of claim 1 wherein the receptacle region has a plurality of corners, each corner being defined by one of the end walls and an adjacent one of the side walls when the side walls and the end walls are secured in the upright container configuration.

46. The container and pallet assembly of claim 45 wherein each of the end walls further defines at least one generally upright reinforcing structure proximate to one of the corners of the receptacle region.

47. The container and pallet assembly of claim 46 wherein the number of generally upright reinforcing structures is four, one generally upright reinforcing structure being positioned proximate to each of the corners of the receptacle region.

48. The container and pallet assembly of claim 46 wherein each of the pair of end walls includes a first wall panel and a second wall panel, said first wall panel and said second wall panel being generally parallel to one another, and wherein each of the end walls includes at least one first reinforcing panel extending from and hingedly connected to said first wall panel and at least one second reinforcing panel extending from and hingedly connected to said second wall panel, said first reinforcing panel and said second reinforcing panel each being pivoted and secured to one another to form the upright reinforcing structures.

49. The container and pallet assembly of claim 48 wherein the first reinforcing panel and the second reinforcing panel each define a generally vertical score line, the first reinforcing panel and the second reinforcing panel each being folded along said score line to form a generally hollow triangular column.

50. The container and pallet assembly of claim 48 further comprising a pair of lid flaps hingedly connected to one of the pair of end walls or the pair of side walls, said lid flaps each being pivotally movable between a closed position in covering relation to the receptacle region and an open position disposed from said closed position, said pair of lid flaps contacting and resting on top of the upright reinforcing structures when said lid flaps are pivoted to the closed position.

51. The container and pallet assembly of claim 1 wherein the receptacle region has a plurality of corners, and wherein each end wall is secured to an adjacent and confronting one of the side walls proximate to one of said corners when the side walls and the end walls are secured in the upright container configuration, each of the end walls being secured to the side walls by one of a plurality of corner overlay panels, each said corner overlay panel being hingedly connected to and extending from one of the end walls or side walls, said corner overlay panels each being removably fastened to one of the adjacent and confronting side walls or end walls adjacent to and confronting the side wall or end wall from which said corner overlay panel extends when the side walls and the end walls are secured in the upright container configuration.

52. The container and pallet assembly of claim 51 further comprising an attachment means for removably fastening the corner overlay panels to the adjacent and confronting side wall or end wall, said attachment means including a plurality of aligned and mating sections of hook-and-loop fastener material attached to the corner overlay panel and the adjacent and confronting side wall or end wall.

53. In a container and pallet assembly having a pallet and a plurality of walls mounted on said pallet, said walls each being pivotally movably to and securable in an upright container configuration defining a receptacle region, and said walls being pivotally movable to a collapsed stored configuration, the improvement comprising:

at least one blank cut from a generally planar sheet material and folded to form one of the plurality of walls, said blank being scored to define a plurality of panels including a first wall panel, a second wall panel extending from and being hingedly connected to said first wall panel, and a third wall panel extending from and being hingedly connected to said second wall panel, said second wall panel being pivotable relative to said first wall panel such that said first wall panel is parallel with and closely adjacent to said second wall panel, said third wall panel being pivotable relative to said second wall panel such that said third wall panel is parallel with and closely adjacent to said second wall panel when the walls are secured in the upright container configuration, said plurality of panels being connected to one another such that said plurality of panels may be pivoted in unison together to the collapsed stored configuration.

54. The container and pallet assembly of claim 53 wherein the receptacle region defines a plurality of corners when the walls are secured in the upright container configuration, and wherein the blank further defines a first reinforcing panel extending from and hingedly connected to one of the plurality of wall panels along a scored fold line and a second reinforcing panel extending from and hingedly connected to a separate one of the plurality of wall panels along a scored fold line, said first reinforcing panel and said second reinforcing panel each being pivoted across said scored fold lines and secured to one another to form an upright reinforcing structure when the walls are secured in the upright container configuration.

* * * * *

UNITED STATES PATENT AND TRADEMARK OFFICE

CERTIFICATE OF CORRECTION

PATENT NO. : 5,020,674

DATED : 6/4/91

INVENTOR(S) : Stanley R. Thorud & LeRoy Miller

It is certified that error appears in the above-identified patent and that said Letters Patent is hereby corrected as shown below:

Column 4, line 45, delete "45" and substitute --45°--.therefor.

Signed and Sealed this

First Day of September, 1992

*Attest:*

DOUGLAS B. COMER

*Attesting Officer*

*Acting Commissioner of Patents and Trademarks*